US007670461B2

(12) United States Patent
Westerkamp

(10) Patent No.: US 7,670,461 B2
(45) Date of Patent: Mar. 2, 2010

(54) PAPERMACHINE FABRIC

(75) Inventor: Arved H. Westerkamp, Dettingen (DE)

(73) Assignee: Voith Patent GmbH, Heidenheim (DE)

( * ) Notice: Subject to any disclaimer, the term of this patent is extended or adjusted under 35 U.S.C. 154(b) by 612 days.

(21) Appl. No.: 11/476,389

(22) Filed: Jun. 28, 2006

(65) Prior Publication Data

US 2007/0000632 A1 Jan. 4, 2007

(30) Foreign Application Priority Data

Jul. 1, 2005 (DE) ..... 10 2005 030 774

(51) Int. Cl.
*D21F 7/08* (2006.01)
*B32B 5/28* (2006.01)

(52) U.S. Cl. ..... 162/358.2; 162/900; 442/277; 442/281

(58) Field of Classification Search ..... 162/116, 162/117, 358.2, 306, 900–604, 348, 58.4; 139/363 A, 425 A; 427/389.9, 394, 501, 427/513, 538, 176, 288, 342, 381, 412; 442/76, 442/104, 105, 118, 164, 268, 270, 275, 277, 442/278, 281, 283

See application file for complete search history.

(56) References Cited

U.S. PATENT DOCUMENTS

| | | | | |
|---|---|---|---|---|
| 4,500,588 | A * | 2/1985 | Lundstrom | 428/212 |
| 4,781,967 | A * | 11/1988 | Legge et al. | 428/109 |
| 5,783,501 | A * | 7/1998 | Schuetze et al. | 442/57 |
| 7,306,703 | B2 * | 12/2007 | Hawes | 162/358.2 |
| 7,306,704 | B2 * | 12/2007 | Hyvonen | 162/358.2 |

FOREIGN PATENT DOCUMENTS

| | | | |
|---|---|---|---|
| EP | 1674612 | | 6/2006 |
| WO | WO/99/41447 | | 8/1999 |
| WO | WO 99/41447 | * | 8/1999 |
| WO | WO 03/091498 | | 11/2003 |
| WO | WO/2004/038093 | | 5/2004 |

* cited by examiner

*Primary Examiner*—Eric Hug
(74) *Attorney, Agent, or Firm*—Taylor & Aust, P.C.

(57) ABSTRACT

The invention relates to a papermachine fabric for dewatering and drying a fibrous web in a machine producing a fibrous web, including a plurality of layers with at least one carrier structure and a fiber batt having at least one fiber non-woven. The papermachine fabric according to the invention includes a fiber batt provided with a coating on at least one side.

26 Claims, 2 Drawing Sheets

PAPERMACHINE FABRIC

BACKGROUND OF THE INVENTION

1. Field of the Invention

The invention relates to a papermachine fabric for dewatering and drying a fibrous web in a machine producing a fibrous web.

2. Description of the Related Art

Known papermachine fabrics, in particular papermachine felts, are traditionally produced from a combination of carrier structures and fiber batts. This type of production of papermachine fabrics generally requires a considerable amount of time and, accordingly, gives rise to high production costs.

In previous years, there were again and again approaches to replacing the carrier structures in the form of woven base fabrics with alternative carrier structures that can be produced more quickly, such as knitted fabrics, laid scrims or the like. However, most of these approaches were unsuccessful. Moreover, these modified papermachine fabrics were distinguished by a reduced stiffness and a reduced creep resistance as compared with conventional fabrics of the same type.

What is needed in the art a papermachine fabric of the type mentioned above in such a way that it exhibits low stretch, associated with linear elastic deformation.

SUMMARY OF THE INVENTION

According to the invention, the fiber batt is provided with a coating, at least on one side. This provision of a coating on at least one side of the fiber batt provides the advantage of lower stretch, associated with linear elastic deformation. In addition, the production costs are reduced considerably by means of a reduction in the production time. The coating according to the invention, which preferably adheres firmly, can be applied to the fiber batt over the entire area or partly.

According to a first embodiment, provision is made for the coating to be a force-absorbing coating. The force-absorbing coating can in this case also include fiber matrix structures. As a result, the possibility is created of designing the carrier structure more simply, that is to say with reduced properties, in particular of a mechanical nature.

The force-absorbing coating can alternatively or additionally be reinforced by using textile reinforcing structures, the intention being for "textile reinforcing structures" to be understood to mean products which, amongst other things, are formed by textile production methods such as weaving, non-woven production, intermeshing methods, laying methods or combinations of the same. Isotropic/anisotropic fiber reinforcing structures can also be provided, which are embedded in the coated layers and/or connected to them.

In a further embodiment, it is proposed to provide the coating with a woven layer on its side facing away from the fiber batt. This woven layer can preferably again have a force-absorbing structure.

In a third embodiment, provision is made for the fiber batt to be provided with a force-absorbing structure on its side facing away from the coating. As a result, the possibility is again created of designing the carrier structure more simply once more, that is to say with reduced properties, in particular of a mechanical nature.

Furthermore, the force-absorbing structure can be provided with a coating on its side facing away from the fiber batt, and the coating can in turn be provided with a fiber batt on its side facing away from the force-absorbing structure.

In a fourth embodiment, it is proposed that the fiber batt be provided on the side facing away from the coating with a coating which, moreover, is preferably a force-absorbing coating. Thus the carrier structure, as already explained, can once more be designed more simply.

The coating according to the invention is preferably firmly connected to its adjacent layer, at least on one side, so that the highest extent of layer adhesion and stability is achieved. In this case, the coating does not necessarily have to be connected to the adjacent layer over the entire area; partial-area connection is certainly adequate, depending on the application. At least in theory, it is conceivable for the coating, particularly on a nonwoven base, to enter into a true connection only with some of the nonwoven fibers.

Furthermore, the coating can be permeable, that is to say permeable from all sides, semi-permeable, that is to say permeable from only one side, or non-permeable, that is to say impermeable on all sides. Thus, the highest degree of utility is created for the coating.

The permeable coating preferably consists of at least one thermoplastic, elastomer, thermosetting or polymer material, in particular polyurethane. On the other hand, the semi-permeable coating preferably has a cast membrane structure.

In addition, the coating can be arranged in such a way that it touches the fibrous web during the use of the papermachine fabric. This reduces and even eliminates the marking tendency of the carrier structure.

Generally, the papermachine fabric according to the invention preferably has a thickness variation which is $\leqq 40\%$, preferably $\leqq 25\%$, in particular $\leqq 10\%$, of the average layer thickness, secondly it preferably has a hardness variation $\leqq 70$ Shore A, preferably $\leqq 35$ Shore A, in particular $\leqq 15$ Shore A, of the average layer hardness.

In one embodiment, the papermachine fabric is a press felt for dewatering and drying a fibrous web in a machine producing a fibrous web, consisting of a plurality of layers and including at least one carrier structure and a fiber batt consisting of at least one fiber non-woven, the press felt having at least two coatings according to the invention and preferably absorbing force and having a top coating.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

FIGS. 1 to 4 each show a schematic, sectional illustration of an extract from an embodiment of a papermachine fabric 1.

A papermachine fabric 1 of this type is used, as is known, for dewatering and drying a fibrous web in a machine producing a fibrous web. It generally consists of a plurality of layers, these being formed by at least one carrier structure and by at least one fiber batt 2 consisting of a fiber non-woven 3. The carrier structure is not illustrated explicitly in the figures.

Figure 1:
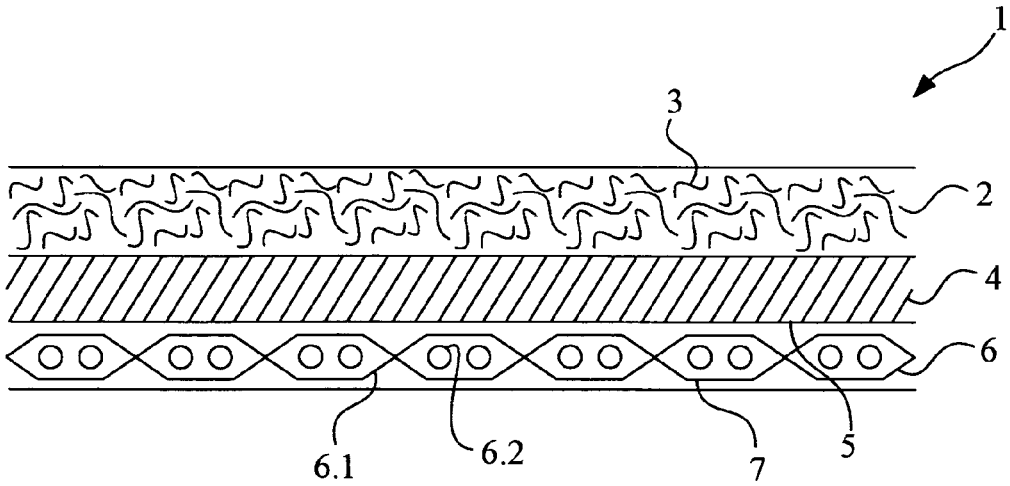
FIGS. 1 to 4 are schematic, sectional illustrations of extracts from papermachine fabrics according to an aspect of the invention.

In a first embodiment according to FIG. 1, fiber batt 2 is provided with a coating 4 on at least one side, the coating preferably being arranged on the inside of fiber batt 2. Furthermore, coating 4 is provided with a woven layer 6 on its side 5 facing away from fiber batt 2. It is also advantageous if woven layer 6 has a force-absorbing structure 7. The force-absorbing structure 7 of the woven layer 6 is formed by threads running towards one another and woven with one another, preferably longitudinal threads 6.1 and transverse threads 6.2. The force-absorbing structure 7 of woven layer 6 can also include fiber matrix structures.

Figure 2:
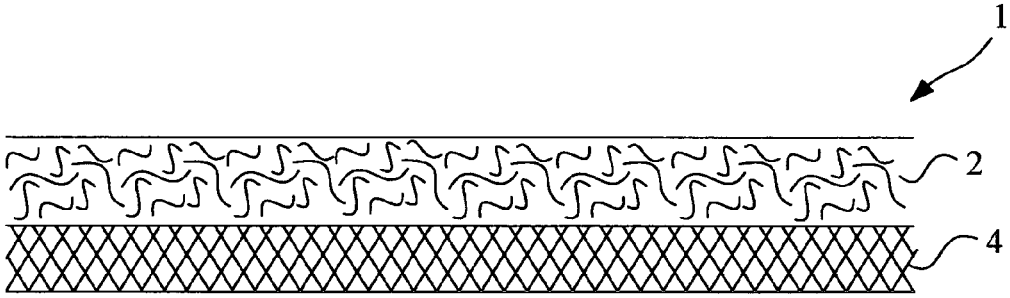

In a further embodiment according to FIG. 2, fiber batt 2 is provided with a coating 4 on at least one side, the coating 4 being a force-absorbing coating.

Figure 3:
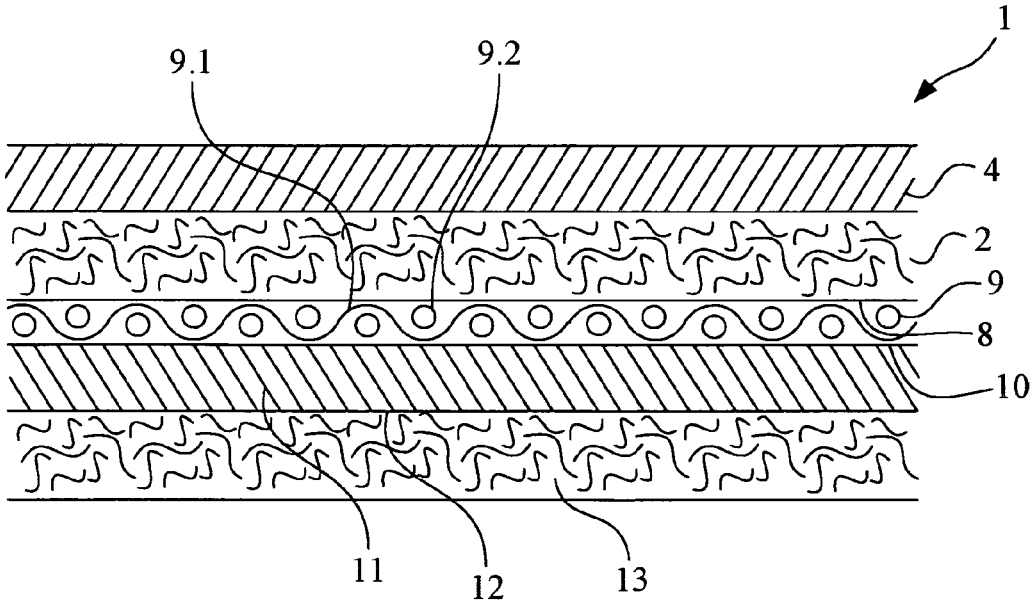

In a third embodiment according to FIG. 3, fiber batt 2 is provided with a force-absorbing structure 9 on the inside of its side 8 facing away from coating 4. The force-absorbing structure 9 is preferably formed by threads running towards one another and woven with one another, preferably longitudinal threads 9.1 and transverse threads 9.2. In this case, coating 4 is arranged on the outside of fiber batt 2. On its side 10 facing away from fiber batt 2, force-absorbing structure 9 is provided with a coating 11 which is in turn provided with a fiber batt 13 on its side 12 facing away from force-absorbing structure 9. The force-absorbing structure 9 on side 12 facing away can also include fiber matrix structures.

Figure 4:
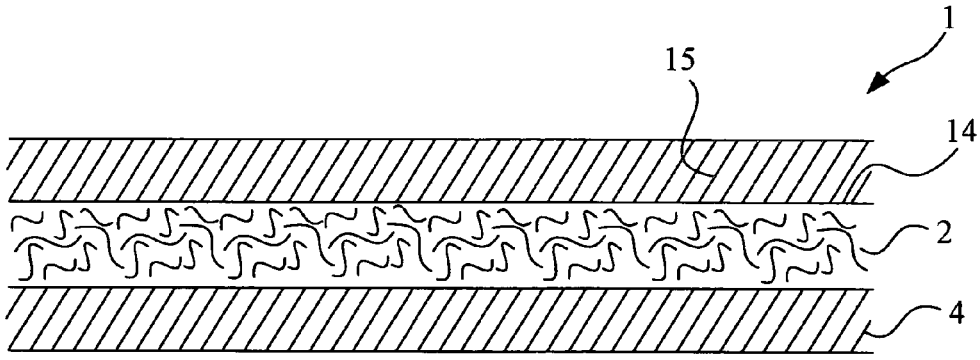

Furthermore, in a fourth embodiment according to FIG. 4, fiber batt 2 is also provided with a coating 15 on the outside of its side 14 facing away from coating 4. Coating 4 is again arranged on the inside of fiber batt 2, following the example of the embodiment of FIG. 1. Coating 15 is preferably once more a force-absorbing coating.

Coatings 4, 11, 15 illustrated in FIGS. 1 to 4 are firmly connected to adjacent layers 2, 6, 13, at least on one side. The respective coating 4, 11, 15 is permeable, semi-permeable or non-permeable, depending on the application. The permeable coating consists in particular of at least one thermoplastic, elastomer, thermosetting or polymer material, in particular polyurethane, and the semi-permeable coating has a preferably cast membrane structure.

Furthermore, respective coating 4, 15 of FIGS. 3 and 4 is arranged in such a way that it touches the fibrous web during the use of the papermachine fabric. It is therefore arranged on the outside.

Figure 5:
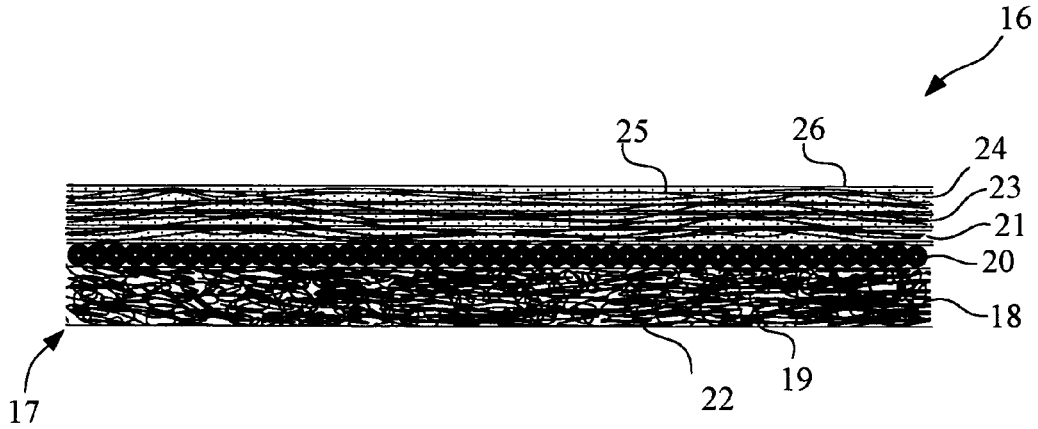
FIG. 5 is a schematic, sectional illustration of an extract from a press felt according to an aspect of the invention.

FIG. 5 shows a schematic sectional illustration of an extract from a press felt 16. A press felt 16 of this type is used, as is known, for dewatering and drying a fibrous web in a machine producing a fibrous web. It generally consists of a plurality of layers and includes at least one carrier structure 17 and a fiber batt 18 consisting of at least one fiber non-woven 19.

Fiber batt 18 is provided with a preferably force-absorbing coating 20 oriented toward the outside, which for its part is in turn provided with a fiber batt 21 consisting of a fiber non-woven 22. The preferably force-absorbing coating 20 is preferably formed both in the machine running direction and in the cross-machine direction.

Fiber batt 21 is once more provided with a preferably force-absorbing coating 23 which for its part is in turn provided with a fiber batt 24 consisting of a fiber non-woven 25. Force-absorbing coating 23 is also preferably formed both in the machine running direction and in the cross-machine direction. The two coatings 20 and 23 can include different materials and accordingly also have different properties.

Furthermore, fiber batt 24 is provided with a final top coating 26, which touches the fibrous web during the use of the papermachine fabric.

That which was stated for the coatings and structures 4, 11, 15 illustrated in FIGS. 1 to 4 with regard to the permeability also applies to coatings 20, 23 illustrated in FIG. 5. Furthermore, it may be common to all the force-absorbing coatings 4, 11, 15, 20, 24 that they consist of resin/foam and threads and/or of a reinforcement via a matrix or via a woven fabric. The matrix can also include pieces of fiber which are embedded in the polymer structure. On the other hand, the woven fabric can include natural fibers, in particular mineral fibers, or else of chemical fibers, in particular synthetically produced chemical fibers (polyaddition, polycondensation or polymerization).

The force-absorbing coatings and structures 4, 11, 15 of FIGS. 1 to 4 can also alternatively or additionally be reinforced by using textile reinforcing structures, the intention being for "textile reinforcing structures" to be understood to mean products which, amongst other things, are formed by textile production methods such as weaving, nonwoven production, intermeshing methods, laying methods or combinations of the same. Isotropic/anisotropic fiber reinforcing structures can also be provided, which are embedded in the coated layers and/or connected to them.

In summary, it is to be recorded that, by way of the invention, a papermachine fabric of the type mentioned at the beginning is developed in such a way that it exhibits low stretch, associated with linear elastic deformation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF DESIGNATIONS

| | |
|---|---|
| 1 | Papermachine fabric |
| 2 | Fiber batt |
| 3 | Fiber nonwoven |
| 4 | Coating |
| 5 | Side facing away |
| 6 | Woven fabric layer |
| 6.1 | Longitudinal threads |
| 6.2 | Transverse threads |
| 7 | Structure |
| 8 | Side facing away |
| 9 | Force-absorbing structure |
| 9.1 | Longitudinal threads |
| 9.2 | Transverse threads |
| 10 | Side facing away |
| 11 | Coating |
| 12 | Side facing away |
| 13 | Fiber batt |
| 14 | Side facing away |
| 15 | Coating |
| 16 | Press felt |
| 17 | Carrier structure |
| 18 | Fiber batt |
| 19 | Fiber nonwoven |
| 20 | Coating |
| 21 | Fiber batt |
| 22 | Fiber nonwoven |

-continued

| LIST OF DESIGNATIONS | |
|---|---|
| 23 | Coating |
| 24 | Fiber batt |
| 25 | Fiber nonwoven |
| 26 | Top coating |

What is claimed is:

1. A papermachine fabric for dewatering and drying a fibrous web in a machine for producing a fibrous web having a plurality of layers, at least one carrier structure and a fiber batt, said fiber batt including at least one fiber non-woven, said fiber batt being provided with a coating on at least one side, wherein said coating includes a woven fabric layer on a side facing away from said fiber batt.

2. The papermachine fabric of claim 1, wherein said woven fabric layer has a force-absorbing structure.

3. A papermachine fabric for dewatering and drying a fibrous web in a machine for producing a fibrous web having a plurality of layers, at least one carrier structure and a fiber batt, said fiber batt including at least one fiber non-woven, said fiber batt being provided with a coating on at least one side, wherein said fiber batt includes a force-absorbing structure on a side facing away from said coating.

4. The papermachine fabric of claim 3, wherein said coating is a force-absorbing coating.

5. The papermachine fabric of claim 3, wherein said coating is a force-absorbing coating, said coating including a woven fabric layer on a side facing away from said fiber batt.

6. The papermachine fabric of claim 5, wherein said woven fabric layer has another force-absorbing structure.

7. The papermachine fabric of claim 3, wherein said force-absorbing structure includes a coating on a side facing away from said fiber batt.

8. The papermachine fabric of claim 7, wherein said coating includes a fiber batt on a side facing away from said force-absorbing structure.

9. The papermachine fabric of claim 3, wherein said fiber batt includes another coating on a side facing away from said coating.

10. The papermachine fabric of claim 9, wherein said other coating is a force-absorbing coating.

11. The papermachine fabric of claim 3, wherein said coating is firmly connected to an adjacent layer on at least one side.

12. The papermachine fabric of claim 3, wherein said coating is permeable.

13. The papermachine fabric of claim 12, wherein said coating is comprised of at least one thermoplastic, elastomer, thermosetting or polymer material.

14. The papermachine fabric of claim 13, wherein said coating is comprised of polyurethane.

15. The papermachine fabric of claim 3, wherein said coating is semi-permeable.

16. The papermachine fabric of claim 15, wherein said coating has a cast membrane structure.

17. The papermachine fabric of claim 3, wherein said coating is non-permeable.

18. The papermachine fabric of claim 3, wherein said coating is arranged to touch the fibrous web during use of the papermachine fabric.

19. A press felt for dewatering and drying a fibrous web in a machine for producing a fibrous web having a plurality of layers, at least one carrier structure and a fiber batt with at least one fiber non-woven, said press felt including at least two force-absorbing coatings and a top coating.

20. The press felt of claim 19, wherein said force-absorbing coatings are on a side facing away from said fiber batt.

21. The press felt of claim 19, wherein said force absorbing coatings are firmly connected to an adjacent layer on at least one side.

22. The press felt of claim 19, wherein said force-absorbing coatings are comprised of at least one thermoplastic, elastomer, thermosetting or polymer material.

23. The press felt of claim 22, wherein said force-absorbing coatings are comprised of polyurethane.

24. The press felt of one of claims 19, wherein said force-absorbing coatings are semi-permeable.

25. The press felt of claim 24, wherein said force-absorbing coatings have a cast membrane structure.

26. The press felt of one of claims 25, wherein said force-absorbing coatings are non-permeable.

* * * * *